US005967043A

United States Patent [19]

Mayr

[11] Patent Number: 5,967,043

[45] Date of Patent: Oct. 19, 1999

[54] BEARING ASSEMBLY FOR A ROLLER OF AN INKING OR WETTING DEVICE

[75] Inventor: Robert Mayr, Neusäss, Germany

[73] Assignee: MAN Roland Druckmaschinen AG, Offenbach am Main, Germany

[21] Appl. No.: 09/073,683

[22] Filed: May 6, 1998

[30] Foreign Application Priority Data

May 7, 1997 [DE] Germany ..... 197 19 305

[51] Int. Cl.[6] ..... B41F 5/00; B41F 31/00

[52] U.S. Cl. ..... 101/352.01; 101/352.01; 101/148; 101/247

[58] Field of Search ..... 101/216, 247, 101/350.1, 349.1, 352.01, 352.02, 352.03, 352.04, 352.07, 352.08, 352.09, 148, 248

[56] References Cited

U.S. PATENT DOCUMENTS

| | | | |
|---|---|---|---|
| 2,033,950 | 3/1936 | Morse | 101/352.01 |
| 4,000,690 | 1/1977 | Geurtsen et al. | 101/350.1 |
| 4,413,560 | 11/1983 | Rogge | 101/350.1 |
| 4,491,071 | 1/1985 | Simeth | 101/248 |
| 4,759,286 | 7/1988 | Witczak | 101/350.1 |
| 5,461,978 | 10/1995 | Chou | 101/247 |
| 5,669,302 | 9/1997 | Rogge et al. | 101/216 |
| 5,683,202 | 11/1997 | Hummel et al. | 101/216 |

FOREIGN PATENT DOCUMENTS

| | | | |
|---|---|---|---|
| 1 250 451 | 9/1967 | Germany . | |
| 42 31 672 C2 | 3/1994 | Germany . | |
| 42 31 673 A1 | 3/1994 | Germany . | |
| 2 061 459 | 5/1981 | United Kingdom | 101/216 |

*Primary Examiner*—Christopher A. Bennett
*Attorney, Agent, or Firm*—Cohen, Pontani, Lieberman & Pavane

[57] ABSTRACT

A bearing assembly for a roller of an inking or wetting device includes a drive device that moves in a first direction to move a roller holder holding a roller from a print ready to an away position. The drive device also moves in a second direction to lock the roller holder onto a base of the bearing assembly at the print ready position. A spring urges the roller holder toward the print ready position when the drive device is inactive.

12 Claims, 3 Drawing Sheets

BEARING ASSEMBLY FOR A ROLLER OF AN INKING OR WETTING DEVICE

BACKGROUND OF THE INVENTION

1. Field of the Invention

The invention relates to a bearing assembly for a roller of an inking or wetting device of a printing machine for moving the roller toward or away from a print ready position.

2. Description of the Related Art

German reference DE 42 31 672 C2 discloses a bearing assembly for a roller in an inking or wetting device of an offset printing machine. Each roller journal is held in a roller holder that is linearly movable toward the print-ready direction. The roller holder runs on a linear guide located in a housing mounted on a frame of the inking or wetting device. Further, the roller holder is urged by a spring toward the print-ready position. The housing also contains a pressure-medium-operated clamping device for clamping the roller holder in the print-ready position.

A problem with this prior art device is that to remove the roller for a roller change, for example, an adjusting device that contains the spring must be detached. Therefore, the roller cannot be moved away from the counter roller or counter rollers in a simple manner.

SUMMARY OF THE INVENTION

It is an object of the invention to provide a bearing assembly for a roller of a printing press that permits the roller to be set and locked in a print ready position and also allows for a simple movement of the roller away from the print ready position.

This object is attained according to the invention by a bearing assembly wherein the roller is urged toward the print ready position by a spring and wherein a drive is connected to the roller holder for pulling the roller away from the print ready position when required. The same drive urges the roller into a locked state in the print ready position. The bearing assembly is economically created from a few simple individual parts and is easy to mount on a printing unit side wall or a machine part that carries the roller. In addition, the bearing assembly does not require a dedicated drive to move the roller into the away position. The roller is moved into the away position quickly and without assembly-related work, thereby reducing the machine downtime for required roller changes.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
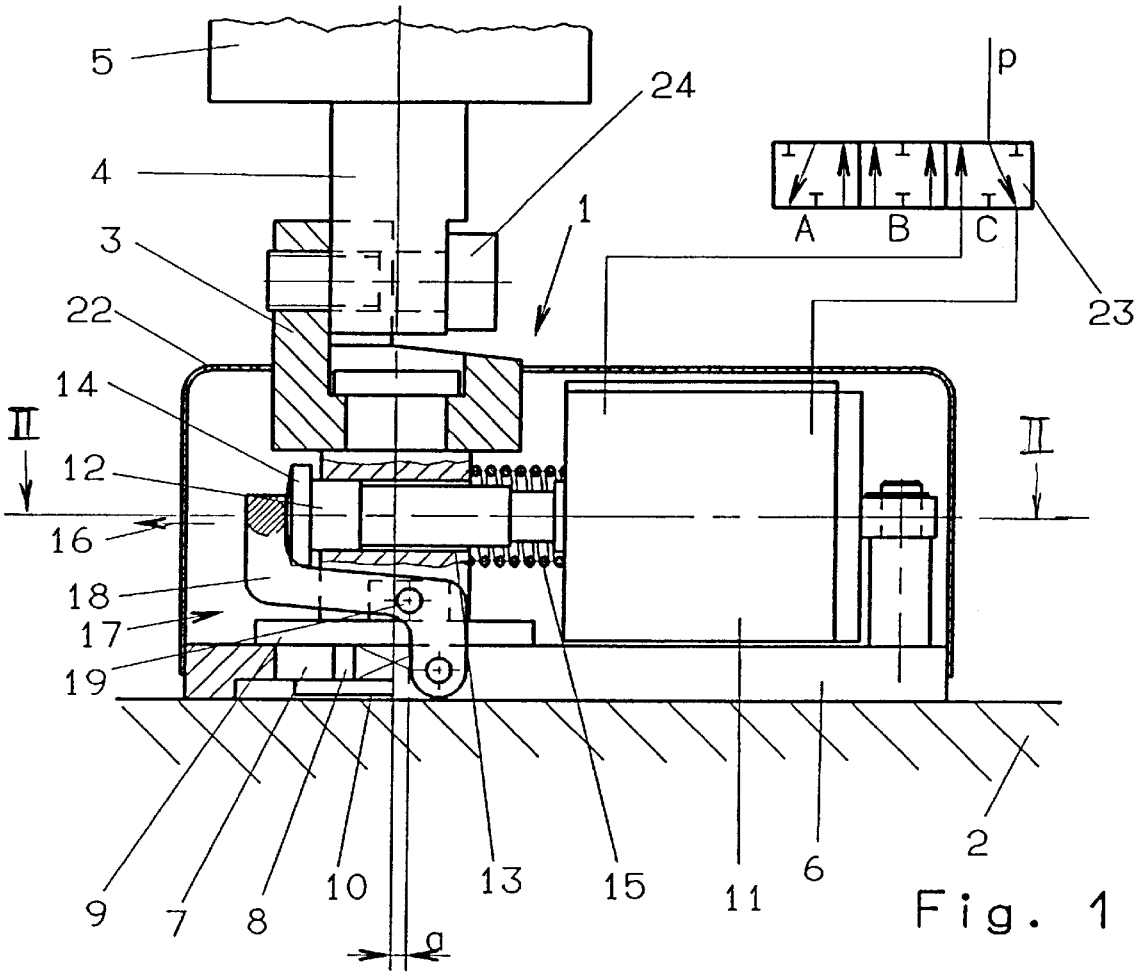
FIG. 1 is a partial sectional view of a bearing assembly according to an embodiment of the present invention with a roller in the clamped position.

Referring initially to FIG. 1, a bearing assembly 1 according to an embodiment of the present invention is connected to the inner side of a printing unit side wall 2. The bearing assembly 1 comprises a roller holder 3 having a trough-shaped recess in which a journal 4 of a roller 5 is placed and fixedly connected. The other journal of the roller 5, which is not shown, is held in a similar bearing assembly attached to the opposite printing unit side wall. The roller 5 is a roller for an inking or wetting device.

The bearing assembly 1 comprises a carrying element 6 in the form of a plate. Carrying element 6 may also comprises other type elements such, for example, as trough-shaped elements. The carrying element 6 comprises a linear guide 7 in which the roller holder 3 is movably mounted. The roller holder 3 comprises a flattened shank 8 for this purpose. The roller holder 3 also comprises a flange 9 seated on the carrying element 6 and is held on the lower side of the carrying element 6 with a disk 10 connected to the bottom of the shank 8.

A drive 11 is connected to the roller holder 3 for selectively moving the roller holder 3 along the linear guide 7. In the embodiment shown in FIG. 1, drive 11 comprises a working cylinder. The drive 11 is mounted on the carrying element 6. The drive 11 carries an activation member 12 in the form of a tappet, which runs through a cross-boring 13 in the roller holder 3 and has a head 14 at its end. A compression spring 15 is arranged between the drive 11 and the roller holder 3. Instead of the compression spring 15 shown, an equivalent tension spring may be provided to draw the roller holder 3 toward the print-ready position.

The bearing assembly 1 also comprises a clamping device 17 that secures or clamps the roller holder 3 in a print-ready position. The clamping device 17 comprises a clamping lever 18 that is pivotally attached to the carrying element 6 and is activated by the drive 11. Pressure blocks 19 and 20 are attached to the clamping lever 18 and are set upon the flange 9 when the clamping lever 18 is in the clamped position. The carrying element 6 is connected to the printing unit side wall 2 by screws 21. Instead of screws 21, many different types of connecting elements may be used to connect the carrying element to the printing unit side wall 2 such for example, as rivets, adhesives, or friction seating elements. A protective covering 22 (not shown in FIG. 2) protects the bearing assembly 1 against possible contamination and damage.

When the drive 11 of the bearing assembly 1 is a working cylinder as shown in FIG. 1, the drive 11 is operated by a pneumatic (or hydraulic) pressure medium with the pressure p. When the directional valve 23 is in Position A (FIG. 1), the roller holder 3 assumes the position shown in FIG. 2. That is, the piston rod of the working cylinder (drive 11) is drawn in so that the head 14 of the tappet 12 pulls the roller holder 3 to the right against the urging force of the compression spring 15. This is the away position, whereat the roller 5 is positioned away from its partner roller or rollers. In this position, the roller 5 may be changed. For this purpose, a screw 24 is loosened, and the roller 5 is removed from the roller holder 3. Alternatively, the roller holder 3 may carry a roller socket, for example, in which the roller is held by its journal.

When the directional valve 23 is moved into Position B, the working cylinder (drive 11) becomes powerless. The compression spring 15 then moves the roller holder 3 and the roller 5 toward the print-ready position 16 until the roller 5 rests against its partner roller or rollers. The partner roller may, for example, comprise a distribution cylinder or a form cylinder. Furthermore, the roller 5 may be moved into a gap between two rollers and positioned against them. The strength of the compression spring 15 is designed such that the roller 15 rests against its partner roller with a desired pressure. The necessary spring force may also be established by an adjustment disk of a selected thickness that is inserted with the compression spring 15 between the roller holder 3 and the drive 11. Instead of the straight guide 7, a curved or other non-linear guide may be provided, which allows the positioning pressure to be adjusted to partner rollers of different diameters. Moreover, the roller holder 3 may be guided by other devices such, for example, as a lever gear. During the setting procedure, the roller holder 3 is moved in the print-ready direction 16 by a distance a into the position shown in FIG. 1.

After the automatic setting procedure, the directional valve 23 is moved into the switching Position C. As a result, the piston rod of the working cylinder drive 11 is extended, whereby the tappet 12 is moved into the print-ready position 16 and its head 14 strikes the clamping lever 18. The pressure blocks 19, 20 of the clamping lever 18 press against the flange 9 of the roller holder 3 and secure the latter in a force-locking manner on the carrying element 6. The bearing assembly 1 is now located in the clamped position shown in FIG. 1, in which the roller holder 3 along with the roller 5 are locked in that position.

To readjust the position of the roller 5 when needed, the directional valve 23 is switched into Position B. The tappet 12 releases the clamping lever 18 and the friction lock of the flange 9 on the carrying element 6 is eliminated. The compression spring 15 now presses the roller holder 3 so that the roller 5 is pressed against its partner roller or rollers into the print-ready position. After this, the directional valve 23 is moved back into Position C to lock the roller holder 3. This type of readjustment can be necessary, for example, to compensate for wear on the roller 5, which in some circumstances may be occur when the roller 5 has a soft cover, or if there is a soft cover on the partner roller(s).

Figure 2:
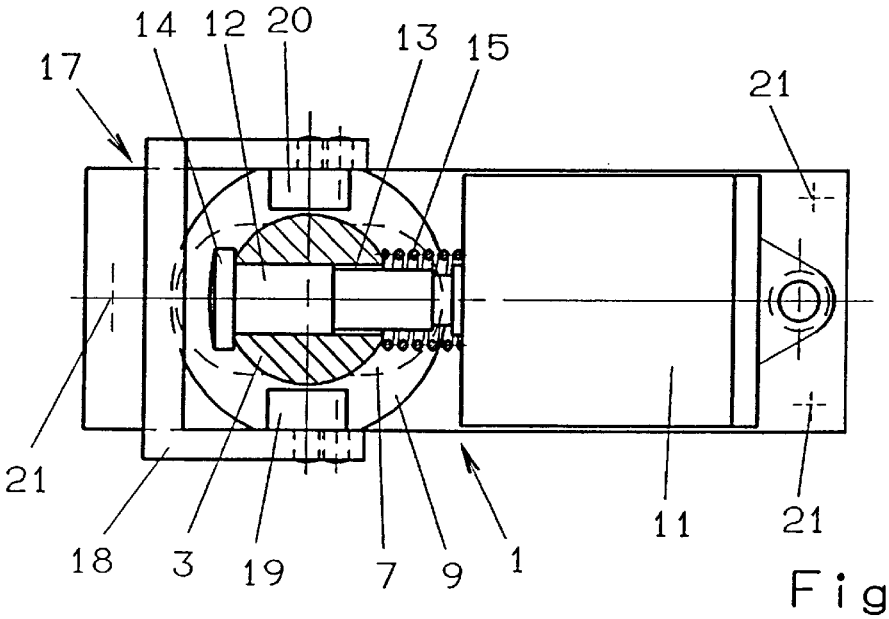
FIG. 2 is a sectional view showing the bearing assembly along the line II—II of FIG. 1 with the roller removed from the print ready position.
Figure 3:
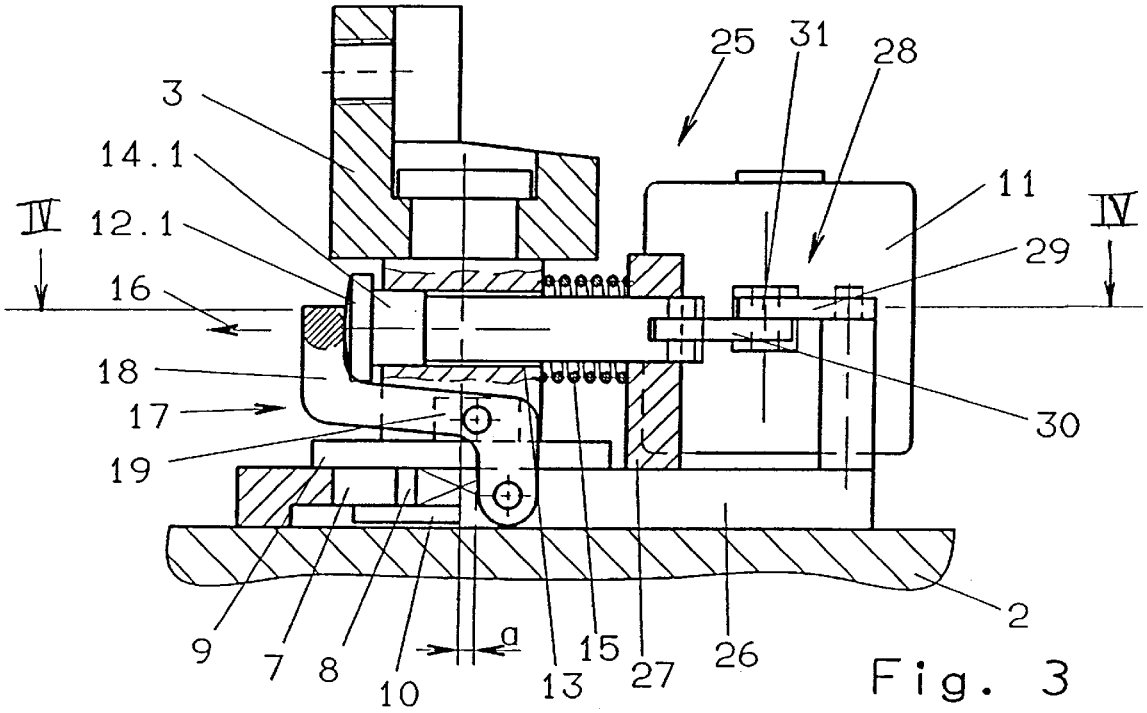
FIG. 3 is a partial sectional view of the bearing assembly according to another embodiment of the present invention in the clamped position.
Figure 4:
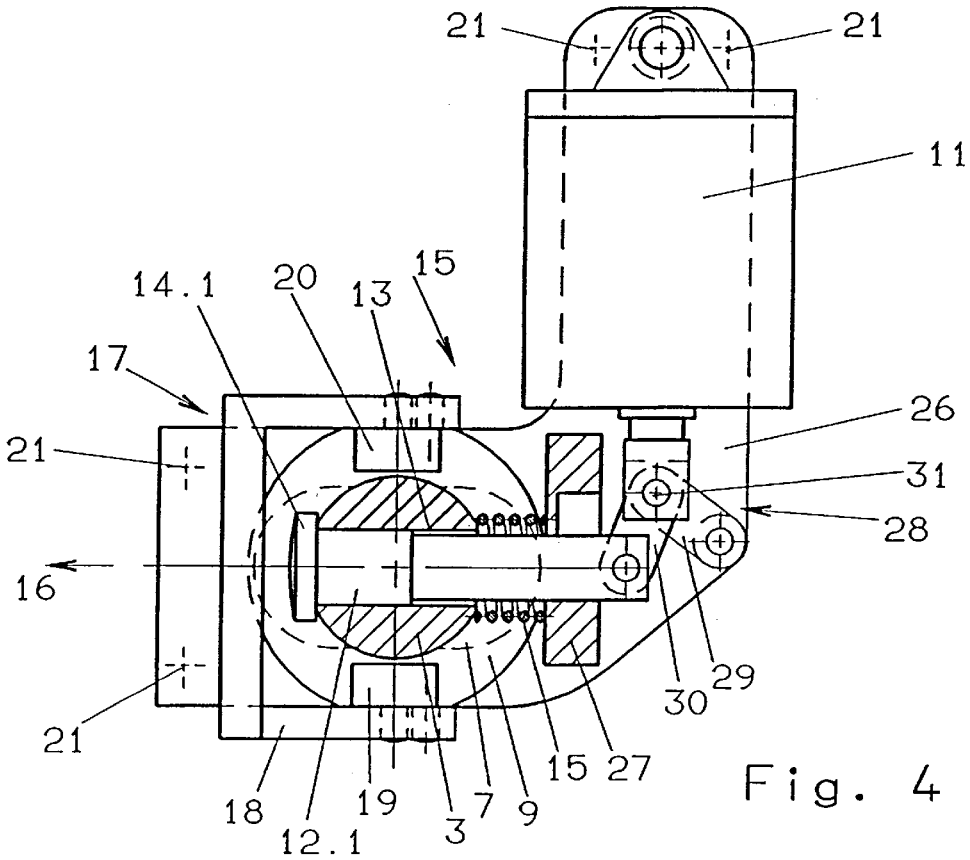
FIG. 4 is a sectional view showing the bearing assembly along the line IV—IV of FIG. 3 with the roller removed from the print ready position.

Another embodiment of a bearing assembly 25 is shown in FIGS. 3 and 4. The essential difference from the bearing assembly 1 in FIGS. 1 and 2 is the angular carrying element or plate 26 on which the elements of the bearing assembly 25 are mounted. The angular plate 26 may be necessary to meet narrow installation conditions. In the description that follows, for the sake of simplicity, the same reference numbers are generally used for parts analogous to those in the bearing a 1. The roller holder 3 carries a roller as in bearing assembly 1 which is not shown in FIGS. 3 and 4. The shank 8 of the roller holder 3 is run in a straight guide 7 of the plate 26 and secured with a disk 10. The clamping device 17 is similar to that in bearing assembly 1 and comprises the clamping lever 18 with the pressure blocks 19, 20 which interact with the flange 9 of the roller holder 3. The working cylinder 11 is secured to the angled leg of the plate 26 so that the compression spring 15 that pressurizes the roller holder rests on a bearing 27 of the plate 26. The bearing 27 also supports the tappet 12.1 which is connected by a lever gear 28 to the working cylinder 11. The lever gear 28 comprises a toggle lever. Specifically, a crank 29 is pivotably mounted on the plate 26 and connected to the tappet 12.1 in articulated fashion by the coupling 30. The piston rod of the working cylinder 11 acts upon the articulated joint 31 of the crank 29 and the coupling 30.

The operation of the bearing assembly 25 is the same as that of the bearing assembly 1 in FIG. 1, so the description of operation will not be repeated. It should simply be noted that FIG. 3 shows the bearing assembly 25 in the working position or clamped position and FIG. 4 shows the away position at which the roller holder 3 is drawn back from the print-ready position which is in the direction of arrow 16. As in FIG. 1, the roller may be changed in the away position. The directional valve to produce the appropriate control states of the working cylinder 11 is identical to the directional valve 23 shown in FIG. 1 and is therefore not depicted again.

Figure 5:
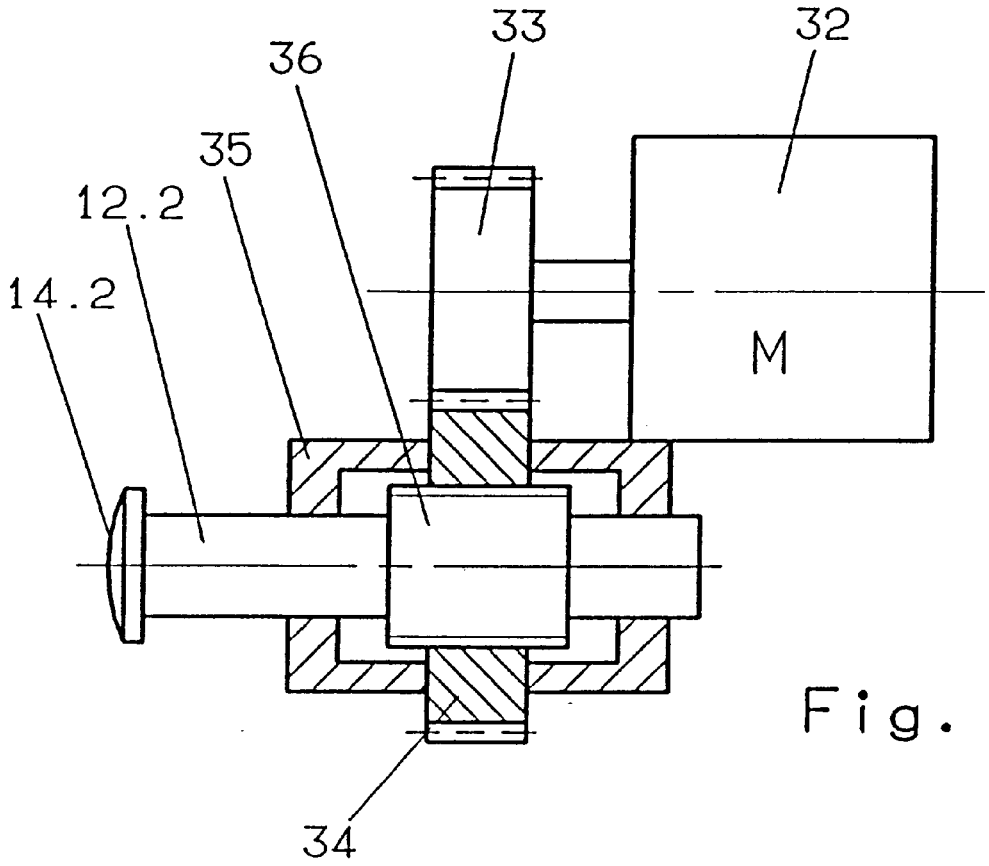
FIG. 5 shows a further embodiment of a drive for the inventive bearing assembly comprising an electric motor with a screw and nut drive.
Figure 6:
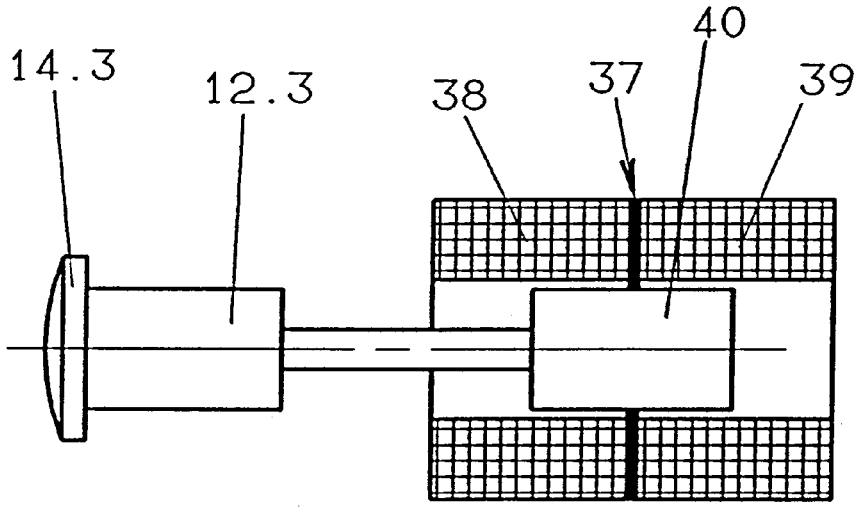
FIG. 6 shows yet another embodiment of a drive for the inventive bearing assembly comprising a bilaterally acting magnet system.

Further drive variants to operate the clamping device or move the roller holder 3 are shown in FIGS. 5 and 6. In FIG. 5, a reversible motor 32 is drivably connected to a pinion 33. When the motor rotates, the pinion 33 drives an externally-toothed screw nut 34 which is held in immovable fashion in a bearing 35 of the carrying element of the bearing assembly. A threaded screw nut is threadably inserted into the screw nut 34, which is connected to an activation element, here, a tappet 12.2. Depending on the rotational direction of the motor 32, the rotation-proof threaded screw 36 is moved, along with the tappet 12.2, in one direction or the other, upon which its head 14.2 either activates the pressing device or draws the roller holder 3 into the away position. Reversible motor 32 is an electric motor in the preferred embodiment but may also be a hydraulic, pneumatic or air motor, or any other device which rotates to move the tappet toward away from the clamped position.

As an alternative to the reversible motor drive in FIG. 5, the drive in FIG. 6 is a bilaterally acting magnetic system 37 shown at a zero setting in the center. The magnet system 37 contains two adjacent coils 38, 39. The anchor 40 of the magnet system is drawn in the direction of the particular coil 38, 39 to which current is applied, and thus moves the tappet 12.3 attached to it.

Instead of being attached to the printing unit side walls 2, the bearing assembly 1, 25 may simply be attached to other machine parts that are provided to carry the roller 5, such as roller levers or shears.

Instead of the tappet 12, 12.1, 12.2, 12.3, other activation elements can be used. For example, a closed fork can encompass the roller holder 3 and act either on the latter or on the clamping device. For the clamping device itself, instead of the pressing device 17, other devices and methods may be used, such for example, as a wedge device.

The invention is not limited by the embodiments described above which are presented as examples only but can be modified in various ways within the scope of protection defined by the appended patent claims.

I claim:

1. A bearing assembly for holding a roller of a printing machine, comprising:

a base;

a roller holder for receiving a journal of the roller and movable on said base with the roller between a print ready position and an away position;

a spring urging said roller holder toward said print ready position; and a drive mounted on said base and connected to said roller holder, said drive being actuatable in a first direction to move said roller holder against a force of said spring to the away position; and a clamping device movably mounted on said base and actuatable to clamp said roller holder onto said base in the print ready position, said drive being actuatable in a second direction to actuate said clamping device.

2. The bearing assembly of claim 1, wherein said drive comprises and an activation element which acts on the roller holder when said drive is actuated in the first direction and which activates the clamping device when said drive is actuated in the second direction and wherein the first direction is opposite the second direction.

3. The bearing assembly of claim 2, wherein said activation element is directly connected to said drive.

4. The bearing assembly claim 2, further comprising a lever gear connected between said activation element and said drive.

5. The bearing assembly of claim 1, further comprising a tappet having a head, wherein said tappet runs through a cross-boring of the roller holder and said head acts on the roller holder when said drive is actuated in the first direction and one the clamping device when said drive is actuated in the second direction.

6. The bearing assembly of claim 1, wherein said roller holder is movable within a straight guide in said base.

7. The bearing assembly of claim 1, wherein said roller holder comprises a flange that is clampable onto the base in a force-locking manner by said clamping device when said drive is actuated in the second direction.

8. The bearing assembly of claim 7, wherein said clamping device comprises a clamping lever having pressure blocks, said clamping lever being pivotably connected to said base and actuatable by the drive for urging said pressure blocks upon the flange.

9. The bearing assembly of claim 1, wherein said drive comprises a working cylinder.

10. The bearing assembly of claim 1, wherein said drive comprises a reversible motor;

a rotatable screw nut that is rotatably mounted in a carrying element on said base and drivably connected to said reversible motor; and a threaded screw fixed in a rotation-proof mounting and threadably inserted in said screw such that said threaded screw moves longitudinally depending on a direction of rotation of said reversible motor.

11. The bearing assembly of claim 1, wherein the drive comprises a bilaterally acting magnetic system having a central zero setting.

12. The bearing assembly of claim 1, wherein said base comprises a plate.

* * * * *